United States Patent [19]

Fava

[11] Patent Number: 4,583,738

[45] Date of Patent: Apr. 22, 1986

[54] GOLF SWING TRAINING APPARATUS AND METHOD

[76] Inventor: Augusto Fava, Via Ferrarese 2, 44042 Cento (Ferrara), Italy

[21] Appl. No.: 608,803

[22] Filed: May 10, 1984

[30] Foreign Application Priority Data

May 13, 1983 [IT] Italy ..... 12517 A/83
May 23, 1983 [IT] Italy ..... 15184/83[U]

[51] Int. Cl.[4] ..... A63B 69/36

[52] U.S. Cl. ..... 273/186 C; 273/191 R; 273/183 E; 273/200 R; 273/190 R; 273/192; 434/252

[58] Field of Search ..... 273/200 R, 186 R, 190 R, 273/191 R, 185 C, 183 E, 192, 186 C; 434/252

[56] References Cited

U.S. PATENT DOCUMENTS 1,854,392 4/1932 Bambrick ..... 273/190 R
2,149,174 2/1939 Johnson ..... 273/186 R
2,961,241 11/1960 Borg ..... 273/200 R

FOREIGN PATENT DOCUMENTS 383767 11/1932 United Kingdom ..... 273/186 R

*Primary Examiner*—George J. Marlo
*Attorney, Agent, or Firm*—Morgan, Finnegan, Pine, Foley & Lee

[57] ABSTRACT

A golf swing training apparatus and method for teaching a golfer to swing a golf club along a predetermined path whereby through repeated practice the golfer becomes habituated to swing form and body posture, the apparatus comprising a base, a timing device for emitting rhythmical tones which correspond to the various phases of a golf club swing, a guide rail for directing the movement of a golf club in a predetermined swing plane to impact a vertical planar surface of an anvil and a positioning rod for controlling the bodily movements of a golfer within a prescribed position during a golf swing.

28 Claims, 14 Drawing Figures

GOLF SWING TRAINING APPARATUS AND METHOD

BACKGROUND AND OBJECTS OF THE INVENTION

The present invention relates generally to an apparatus and method for golf swing training and, more particularly, for guiding the swing of a golf club in a predetermined path and controlling the bodily movements of a golfer within a prescribed position during a golf swing.

The apparatus and method of the present invention enables a golfer, irrespective of his skill level, to acquire the correct golf swing posture by swinging an elastic or other type of golf club along the swing plane of a guiding means. The term "swing" can be defined as the sum of rhythmic back and forth movements which result in striking a golf club head against a golf ball. It is common knowledge that to acquire a correct golf swing, one must have, at the outset, a regular tempo, i.e., a speed at which movement is to be performed in the most efficient and constant way as is practicable. To swing properly a golfer must also develop a regulated pattern of movement such that the velocity of each swing will recur with measured regularity. All of the above movements co-act so as to produce a muscular movement of the body which will result in a repeated contact of the golf ball during golf swing play.

To acquire the movements described above, the majority of golfers would require many hours of training on the golf green. Since most golfers cannot be present on the golf green with the necessary assiduousness that is required to develop such movements, the present invention provides a method and apparatus which will enable the golfer to practice swing movements either indoors or outdoors so as to acquire a correct swing posture when effectuating both driving and putting shots. The instant invention can be used by amateur golfers in learning to swing properly and in developing correct body posture when swinging a golf club. The present invention may also be used by professional golfers or golf instructors to correct swing errors and muscular movements of the arms and body.

Many golf swing training devices have been proposed for instructing golfers in swinging golf clubs. Such devices, however, utilize means which are expensive to produce, and difficult and cumbersome to use in such a way as to be undesirable for use indoors or in an area where there is a small volume of space.

U.S. Pat. No. 4,071,251, for example, discloses a golf swing training device containing adjustable means to vary the swing plane and path. The device includes a plurality of adjustable guide rails for defining a swing plane and path and a bell means for informing the player if he deviates from such path. Although this golf swing instruction device may operate adequately to position a golf club in a desired swing plane and signal the golfer when he deviates from such swing plane, there is the danger of repeated deviation from the desired swing plane because there is a separation between the guide rails which is wider than the diameter of the shaft of the golf club thus allowing the golf club to pass freely in the swing plane. Such a device does not control the actions of the golfer's body used to produce the desired swing and thus allows the golfer to deviate from the swing plane. As a result, the golfer will not develop those bodily movements which will insure a correct swing pattern each time.

Other devices proposed for instructing an individual in the proper manner to swing a golf club utilize guiding means such as track members connected to a platform for guiding a golf club through a golf swing (U.S. Pat. No. 3,489,416) or guide rails separated a predetermined distance to define a swing plane through which a golf club can move (U.S. Pat. No. 2,653,025). By and large, such devices encounter the same problems mentioned above.

Accordingly, it is a principal object of the present invention to provide a new and improved golf training device which can be used by an amateur golfer to learn body posture and muscular movement necessary to swing a golf club correctly. In addition, it is an object of the invention to provide such a golf training device which can also be used by professional golfers to correct swing errors.

Another object of the present invention is to provide a new and improved golf training device which provides means for guiding a golf club along a predetermined swing plane or path.

A further object of the present invention is to provide a new and improved golf training device which provides a timing means so as to enable a golfer to acquire a regulated pattern of movement when swinging a golf club against a golf ball.

It is yet a further object of the invention to provide a new and improved golf training device which enables a golfer to control his bodily movements within a prescribed position during a golf swing by providing both torso and head positioning means.

It is also an object of the present invention to provide a simple unitary golf training device which is collapsible so that it may be stored indoors. In addition, the invention provides a golf training device which is compact in size, economical to fabricate and easy to assemble such that it may be used indoors, i.e., in a home or in an office, when it is not possible to go out onto a golf course.

It is yet a further object of the present invention to provide a method for teaching a golfer to properly swing a golf club along a predetermined path whereby through repeated practice the golfer becomes habituated to proper swing form and body posture.

The foregoing and other objects and advantages of the invention will be apparent to those skilled in the art from the following detailed description when taken in conjunction with the accompanying drawings.

SUMMARY OF THE INVENTION

The present invention is directed to a golf swing training apparatus and method for teaching a golfer to properly swing a golf club along a predetermined path or swing plane whereby through repeated practice the golfer becomes habituated to proper swing form and body posture. Briefly described, the apparatus comprises a base member, a timing means for emitting rhythmical tones which correspond to the various phases of a golf club swing, a guiding means for directing the movement of a golf club in a predetermined swing plane and positioning means for controlling the bodily movements of a golfer within a prescribed position during a golf swing.

It will be understood by those skilled in the art that the object and advantages specifically enumerated herein are achieved by the invention as disclosed and embodied herein. Thus, it will be found that providing the timing means for emitting rhythmical tones which correspond to the various phases of a golf club swing and a guiding means for directing the movement of a golf club in a predetermined swing plane, a golfer can become habituated to proper swing form and body posture when striking his club against a golf ball. In addition, it will be found that the golfer will acquire a correct golf club swing as soon as he is able to strike his club against the golf ball simulator of the present invention in attunement with the rhythmical tones which are cyclically repeated. As a result the golfer will develop a regulated pattern of movement which, in turn, will result in repeated contact of the golf club with the ball during golf play.

It will also be found that the unitary golf training apparatus of the present invention is relatively easy and inexpensive to fabricate and is compact in size such that it may be used indoors, i.e., in a home or in an office, when it is not possible to go out onto a golf course.

It should also be noted that although the apparatus of the present invention is discussed hereinafter in terms of being adapted for use by right-handed golfers, it should be understood that the apparatus may be used universally, i.e., by both right-handed and left-handed golfers.

It will be understood that the foregoing general description and the following detailed description are exemplary and explanatory of the invention and are not intended to be restrictive thereof. The accompanying drawings, referred to herein and constituting a part hereof, illustrate preferred embodiments of the invention, and, together with the description, serve to explain the principles of the invention.

BRIEF DESCRIPTION OF THE DRAWINGS

For fuller understanding of the invention, reference is had to the following detailed description taken in connection with the accompanying drawings of preferred embodiments in which.

DETAILED DESCRIPTION OF PREFERRED EMBODIMENT

Figure 1:
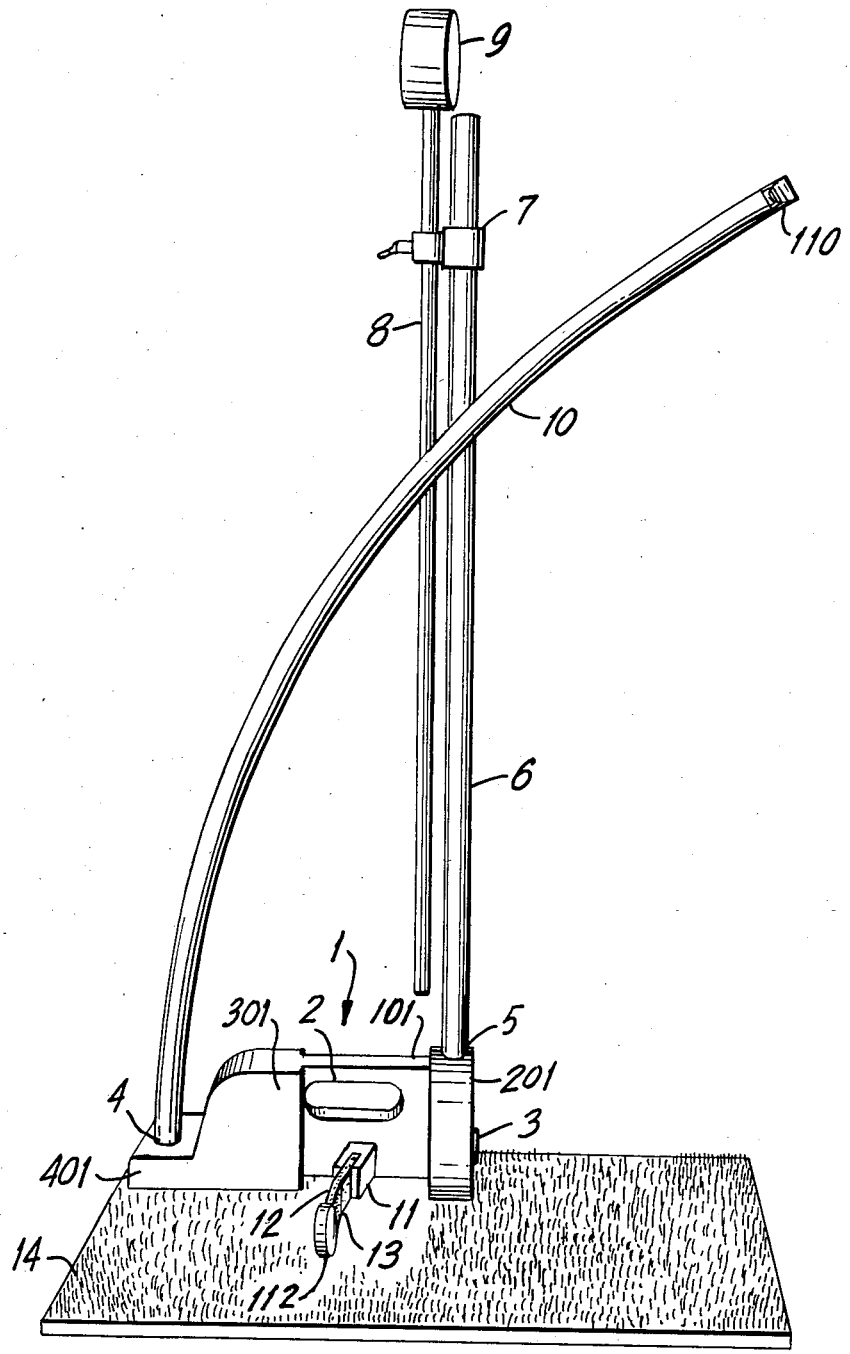
FIG. 1 is a side elevation view of the apparatus of the invention in its collapsed or inoperative position.

Referring now more particularly to the accompanying drawings, wherein like reference numerals designate similar parts throughout the various views, the apparatus of the instant invention includes base 1 having an elongated and flattened intermediate portion 101 on the upper portion of which is mounted handle 2. It will be understood that the base member of the present invention is not limited to any particular size or shape and may be constructed of a variety of materials. Base member 1 has, at either end, a header or anvil 201 which is rounded at its top end. It should be understood, however, that anvil 201 of the present invention is not limited to any particular size or shape, provided that it has a planar and vertical front surface. As can best be seen from FIG. 5, anvil 201 is preferably provided with a color dot 3 which represents the target against which a golf club head will strike.

As shown in FIG. 1, base member 1 includes section 401 having a vertical bore 4 mounted opposite of anvil 201. Section 401 is adapted to receive guide rail 10 when the apparatus of the present invention is in the collapsed or inoperative position.

Anvil 201 is provided with a bore 5 in which either end of a vertical rod 6 can be removably secured. Rod 6, which is made of aluminum tubing or any suitable material, can be a unitary structure or composed of tubular sections each of about one meter in length. Clamp 7 is mounted on rod 6 for receiving positioning rod 8 which preferably carries at either end a pad 9 or any other means suitable for placement on a golfer's head. In a like manner, positioning rod 8 is preferably made of aluminum tubing and can be either a unitary structure or composed of several tubular sections.

It should be understood that numerous fastening arrangements, such as friction linkages and the like, might be employed in substitution of clamp 7 for positioning reference rod 8 and pad 9. For example, rods 6 and 8 could be connected by a friction linkage rather than by clamp 7. In a like manner, rod 6 could be connected to anvil 201 by such a friction linkage.

In the present invention, anvil 201 is preferably provided with at least one through-passage 501 which is parallel to the longitudinal axis of base member 1. Through-passage 501 is spaced from the central axis of anvil 201 so as to receive guide rail 10 which is removably secured thereto Guide rail 10 may be composed of aluminum tubing and can be of a unitary structure or composed of several interconnected tubular sections. It should be noted that guide rail 10 is tapered at its distal end 110, i.e., pointed or flattened, so that a golfer does not strike the end of guide rail 10 with his club during training. Distal end 110 is preferably painted with a color contrasting with that of rail 10 so as to be clearly visible. It should also be noted that guide rail 10 of the present invention can be assembled to a predetermined contour to from the correct swing plane and path for a golfer.

In some applications, guide rail 10 is provided with a reference mark or graduated collar on the end to be inserted into anvil 201 which cooperates with a graduated scale or a reference mark integrally formed on anvil 201 so as to position guide rail 10 in a pre-selected direction.

For reasons more apparent from the description which follows, the apparatus of the instant invention is designed so that guide rail 10 can be made as a unitary structure or composed of several tubular sections which communicate with each other so that a golf club can slide on the assembled guide rail 10 without any hinderance. Use of tubular sections permit expansion or reduction of the length of guide rail 10 in accordance with the golfer's individual requirements. Preferably, the tubular sections comprising guide rail 10 are tapered on one end so that they can be slipped into each other for assembly of guide rail 10. When the apparatus of the instant invention is no longer in use, guide rail 10 can be without drawn from anvil 201 and is preferably inserted into vertical bore 4 of socket 401 so as to save space.

Figure 9:
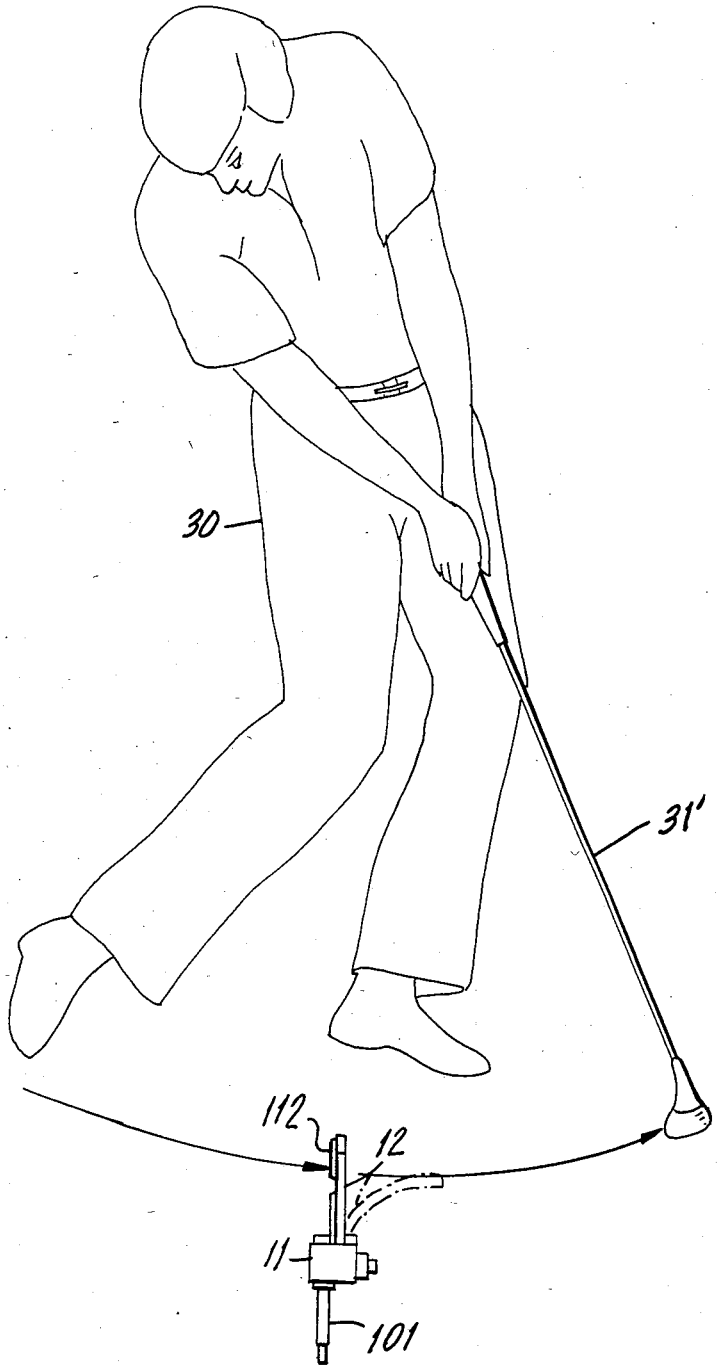
FIG. 9 is a sectional view of still another embodiment according to the present invention.

As shown in FIGS. 1 and 9, intermediate portion 101 of base member 1 is provided with a transverse through-passage to which there is secured by a fastening means a clamp 11 which is positioned on one side of base member 1. Clamp 11 supports a removable and flexible strip 12 which has at its free end a round boss 112 facing anvil 201. Flexible strip 12 is made up of reinforced rubber or like material and is preferably colored in contrast with the color of boss 112. The transverse orientation of strip 12 can be adjusted by manipulating the fastening means for clamp 11 so as to match the different lies of the heads of the various golf clubs to be used for training against strip 12.

Figure 2:
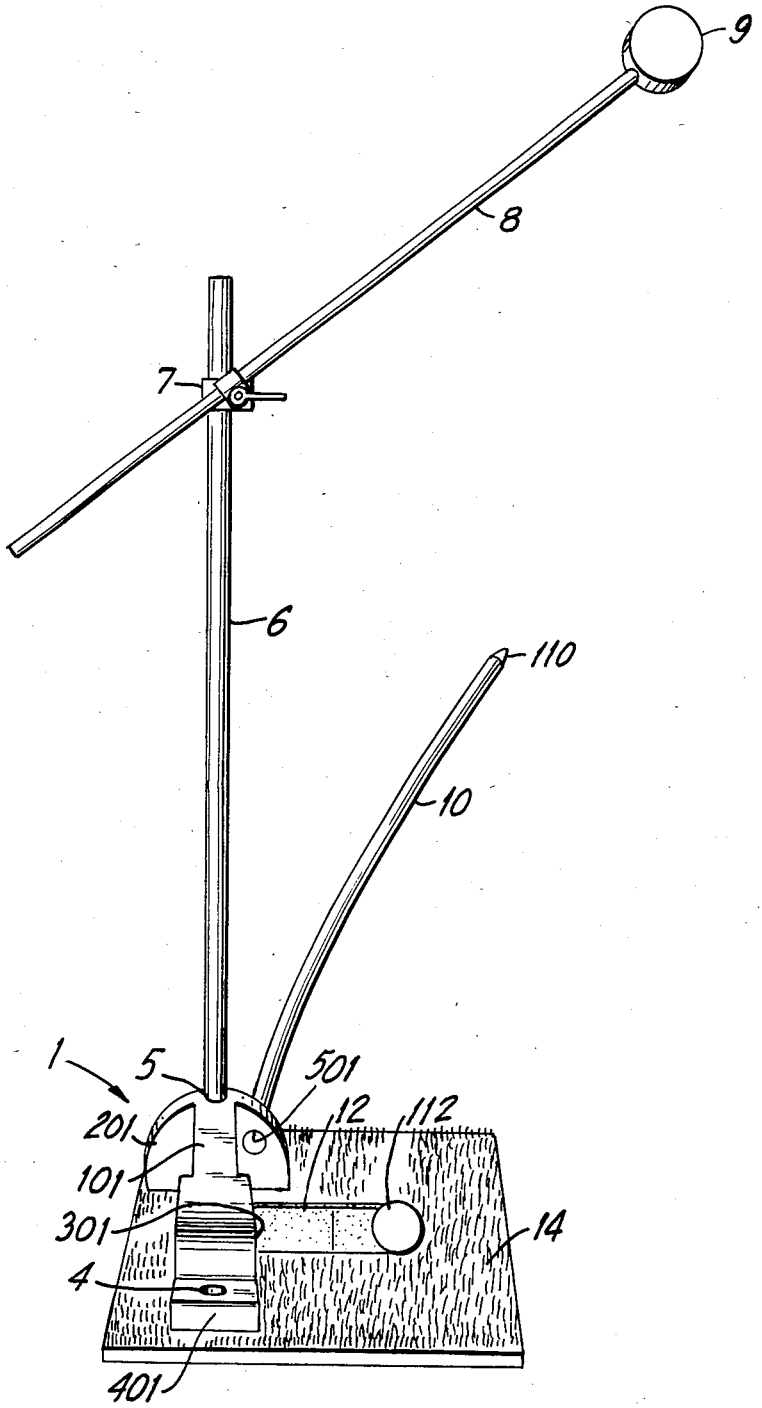
FIG. 2 is a rear view of the apparatus of FIG. 1 in its operative position.

As shown in FIGS. 1 and 2, after strip 12 is struck, it is returned to its initial position in the swing plane by the use of abutment 301 against which strip 12 bumps after having been struck by a golf club. Abutment 301 produces a rebound so as to enable strip 12 to return to its original resting position. On the back side of strip 12 which is directed towards anvil 201, strip 12 is provided with a reinforcement rib 13 which is secured to clamp 11. Rib 13 resists the striking force against strip 12 so as to enable strip 12 to rebound to its original position. Rib 13 may be made of any suitable material such as reinforced rubber or plastic.

As previously noted, the apparatus of the present invention is discussed in terms of being adapted for use by right-handed golfers, however, it may be used universally, i.e., by both right-handed and left-handed players. For example, the apparatus may be adapted for left-handed players by providing a second through-passage opposite through-passage 501 on anvil 201 to secure guide rail 10 and by placing abutment 301 in a position opposite to that used for right-handed players on base member 1 so that clamp 11 and strip 12 can be arranged on the same side as abutment 301.

Figure 10:
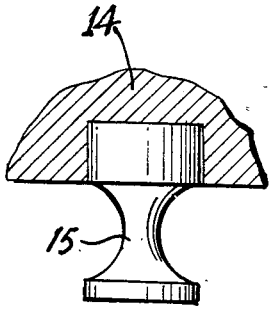
FIG. 10 is a lateral view of another embodiment of the present invention showing exemplary constraining means according to the invention.
Figure 14:
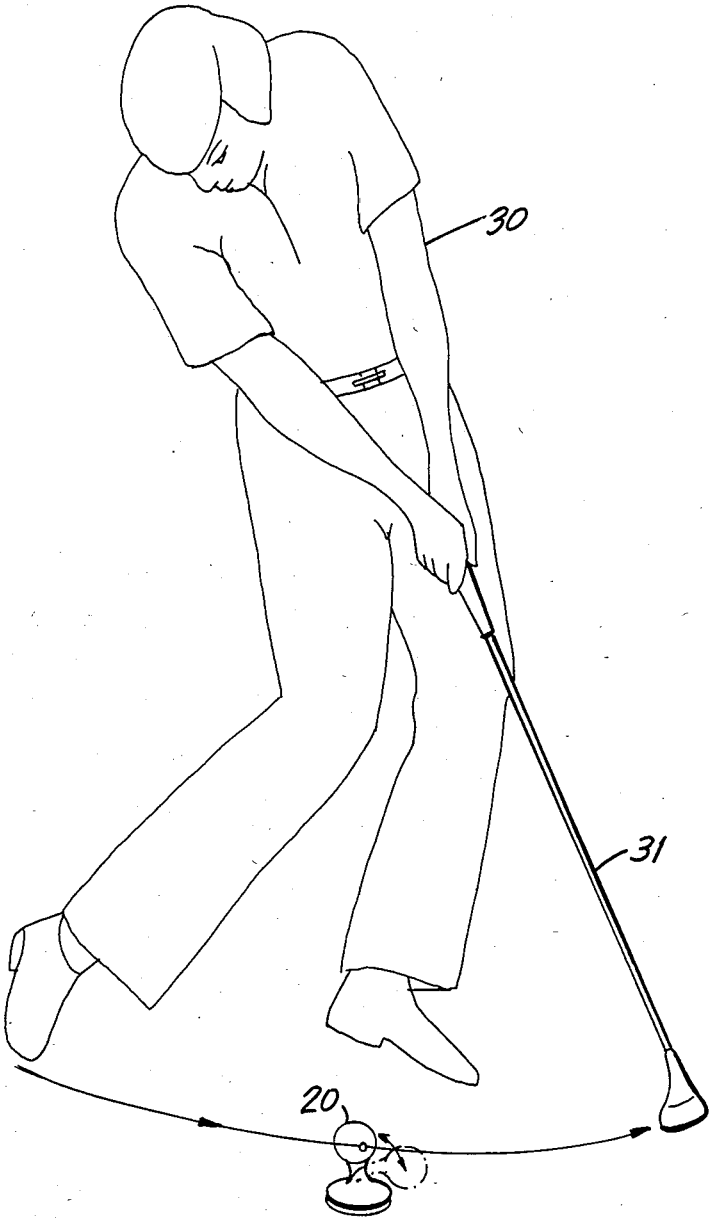
FIG. 14 shows a golf player utilizing a method of the instant invention in learning to swing properly.

As shown in FIGS. 1 and 10, base member 1 preferably includes a mat 14 made of a synthetic material which simulates the grass of a golf course. Mat 14 has a plurality bores through which constraining means 15 are allowed to pass to secure base member 1 to the ground. Constraining means 15 preferably have a cup-like form and can be placed in any number on the bottom side of base member 1. As preferably embodied, base member 1 has at least two constraining means 15 under anvil 201 and at least one such constraining means 15 under socket 401. Constraining means 15 insures that the apparatus of the present invention is firmly secured to the ground during the performance of a golf swing into anvil 201 or boss 112 of strip 12.

Figure 3:
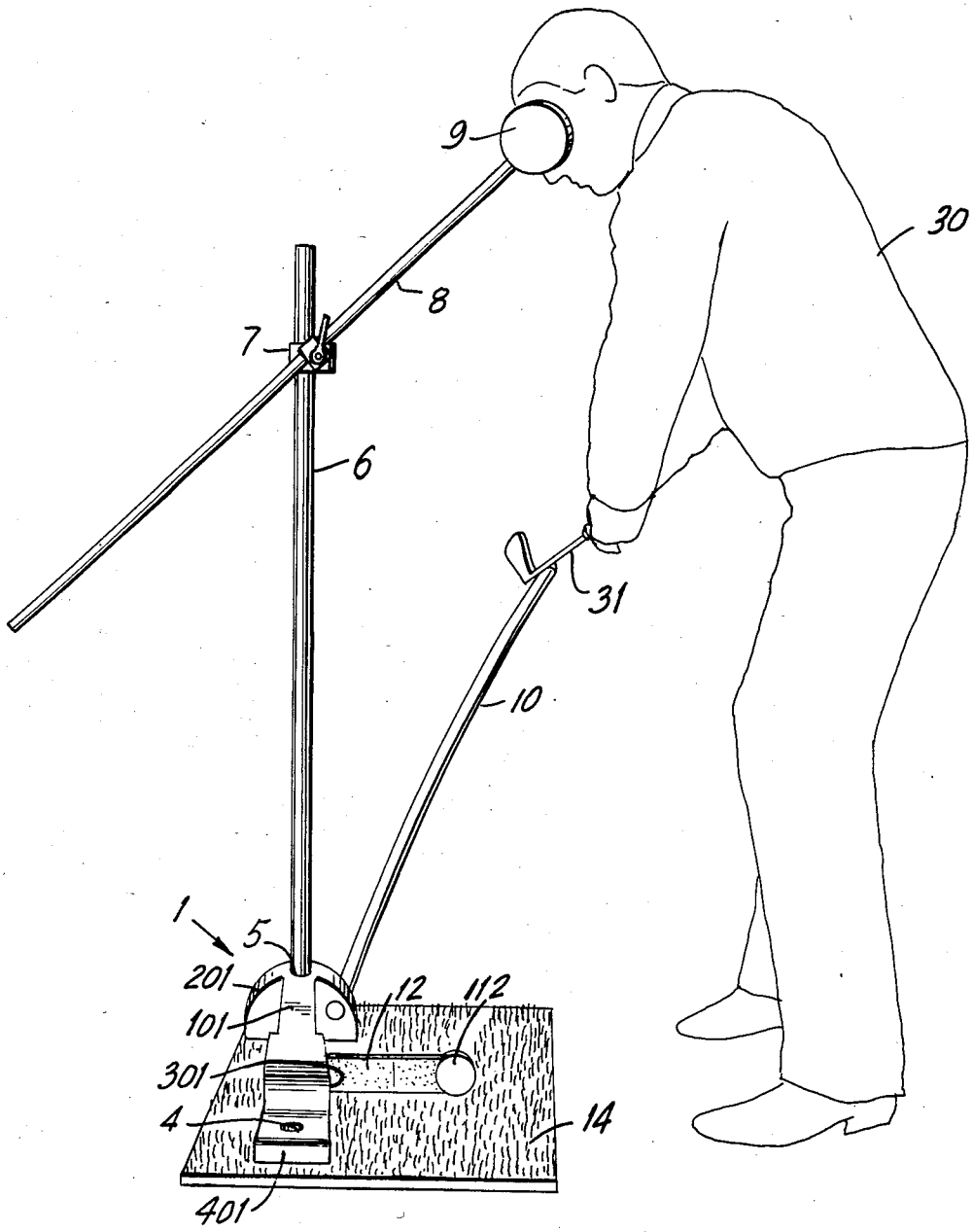
FIGS. 3 and 4 are views of the apparatus of FIG. 2, when employed by a golfer to learn how to move a golf club in a convex swing plane.
Figure 4:
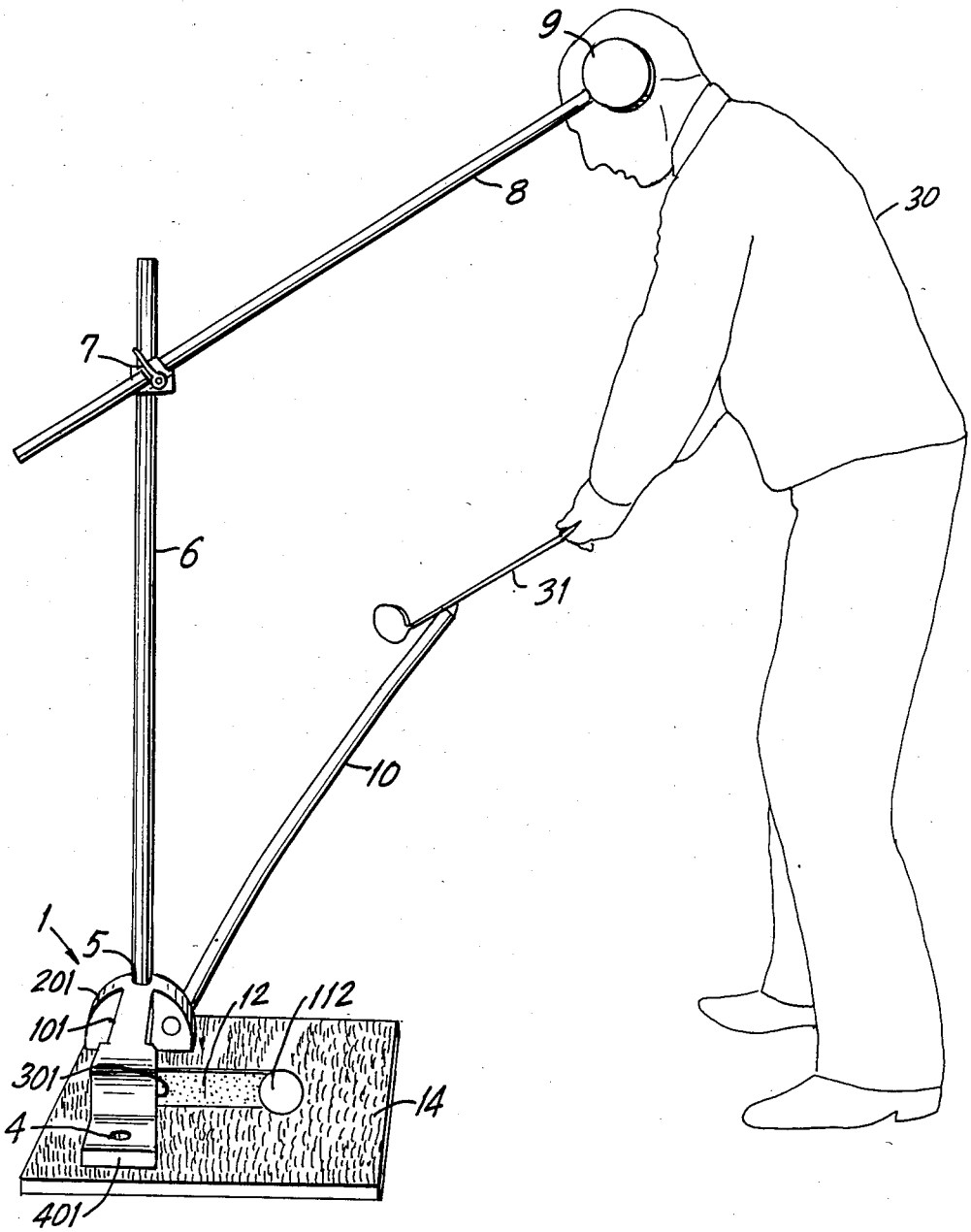

Turning now to FIGS. 3 and 4, there are shown various ways a golfer may properly position himself to practice the path of movement for proper swing form for wood shots. For example, golfer 30 places himself laterally of anvil 201 and rests the head of golf club 31 against target 3 on the frontal wall of anvil 201 as though he was striking target 3 upon completion of a drive swing. Once so positioned, golfer 30 then releases twin clamp 7 and adjusts rod 8 so as to bring pad 9 against the side of his head. Clamp 7 is then fastened so that rod 8 positions golfer 30 in the path of movement to properly address target 3.

In one operation of the invention, golfer 30 rests the side of his head against pad 9 and then raises golf club 31 so that the head of the club is positioned on the proximal end of guide rail 10. It should be noted that prior to engaging in this exercise, guide rail 10 is adjusted to have the proper swing arc and positioned in the correct swing plane. Preferably guide rail 10 is positioned so that it forms a convex swing plane. Also advantageously, guide rail 10 can be adjusted to the type of golf club used by the golfer.

Once the head of golf club 31 is positioned on guide rail 10, golfer 30 can begin to backswing club 31 towards the distal end of guide rail 10 and then with gradually increasing strength commence the downswing of club 31 along guide rail 10 until he approaches impact with target 3. The repetition of this exercise will not only teach the amateur golfer the proper muscular movements of the arms and body for correct swing form, but will maintain the golfer's head steady during swing movements, and define the proper path of movement for a golf club during a swing.

Figure 5:
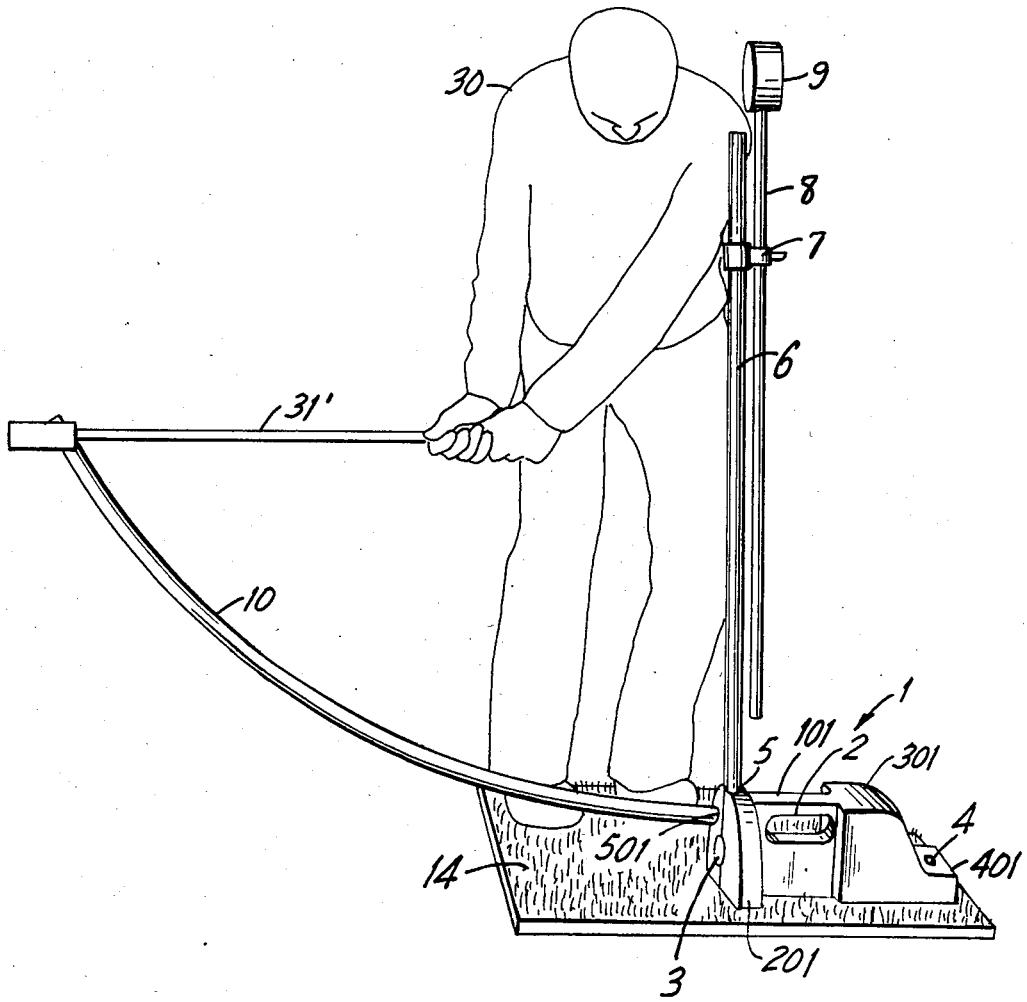
FIGS. 5 and 6 are lateral views of the apparatus of FIG. 2 when it is used for swing training with an elastic golf club.
Figure 6:
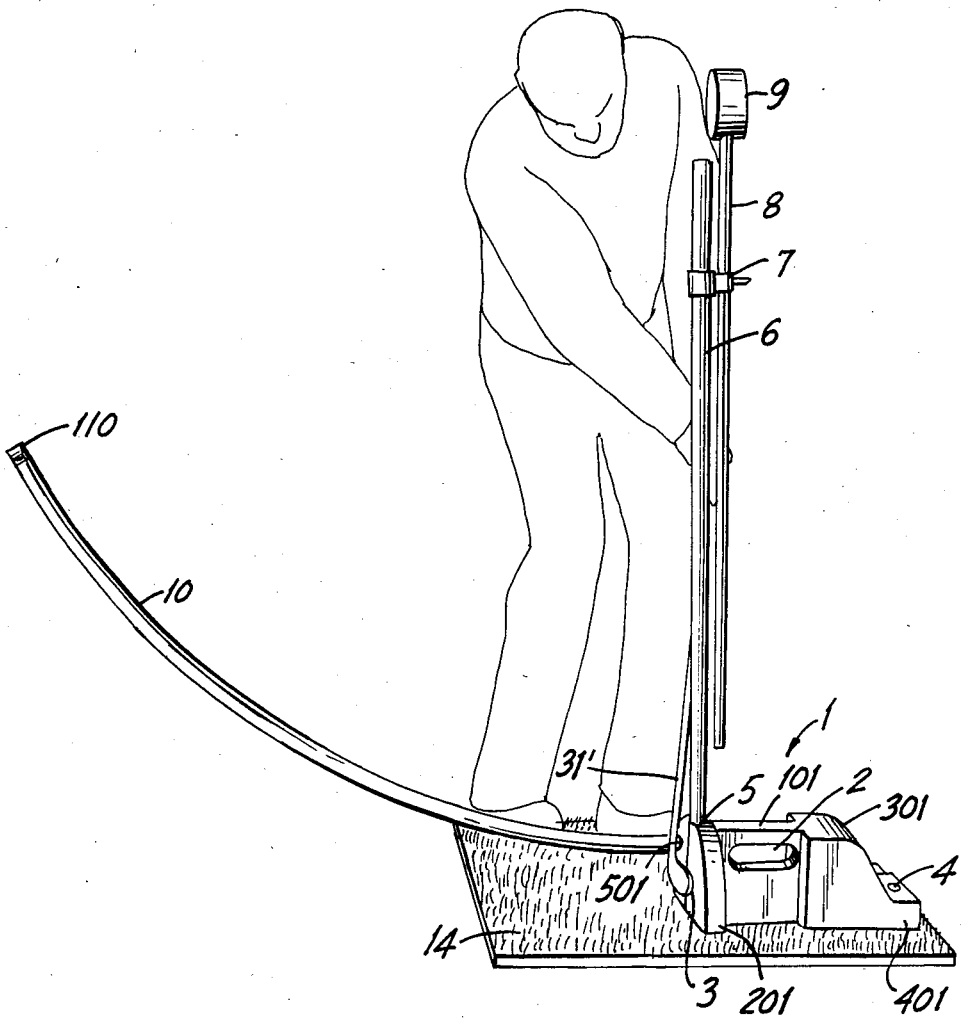

Referring now to FIGS. 5 and 6, there is shown a further exercise which a golfer may perform to aid him in cocking and uncocking the wrists. Preferably, golf club 31' is supplied together with the apparatus of the instant invention and used for this exercise. Golf club 31' is characterized by having a flexible rod and a comparatively flat and heavy head piece.

In the operation of this exercise, guide rail 10 is first positioned so that it forms a concave swing plane. Golfer 30 then raises club 31' so that the head of club 31' is positioned on the distal end of guide rail 10. By following guide rail 10, golfer 30 will swing club 31' downward so that the head of club 31' strikes target 3 of anvil 201. As is apparent from FIG. 6, the flexible nature of club 31' acts in such a way that as the club head strikes target 3 of anvil 201, the golfer's wrists become straightened at a point beyond impact. This exercise is also useful in teaching golfer 30 how to drive a golf club and to impress the maximum possible power to a conventional golf club.

Advantageously, the head of club 31' is laterally flattened so that when it is moved along guide rail 10, both the club and the golfer's wrists become aimed correctly. After having practiced swinging club 31' in the correct swing plane, golfer 30 will be able to swing club 31' back beyond the distal end of guide rail 10 and utilize guide rail 10 as a reference in beginning a backswing and following through to a downswing of club 31'.

As shown in FIG. 9, after having performed the aforementioned exercises, golfer 30 will be able to practice wood shots using a conventional golf club by cyclically swinging the club and striking the enlarged boss 112 of strip 12 which simulates a golf ball. It will be understood that during this exercise, golfer 30 may use guide rail 10 as a reference for the path of movement, even though guide rail 10 remains out of the swing plane, and rod 8 to properly position his body and keep his head steady.

For reasons more apparent from the description which follows, it is preferable that the wood shot training against boss 112 of strip 12 be performed simultaneously with the golfer listening to rhythmical tones. The rhythmical tones are repeated at regular intervals which correspond to the timing of correct swing movements, i.e., the phases of backswing and downswing of a golf club, and emit a marked tune corresponding to the impact of a club against a golf ball. Golfer 30 will acquire a correct swing when he succeeds in striking the club against boss 112 of strip 12 in attunement with the rhythmical tones.

As best shown in FIG. 9, when the club head strikes boss 112 incorrectly, golfer 30 is instantly made aware from the resulting noise that his swing was improperly directed. Strip 12 is so oriented such that when boss 112 is correctly struck, it contacts the flat portion of the club head and produces a quick, sharp and marked sound.

The instant invention also overcomes many of the problems experienced by a golfer during the performance of a putting stroke. For example, when putting, most golfers will turn their head to see if the golf ball enters the hole. This head movement is generally conducive to an incorrect putt since the golfer loses his stance when executing his shot. The present invention is adapted to remedy this defect by providing a putting strip 18 to aid the golfer in perfecting his putting stroke and enabling him to practice iron shots.

Figure 7:
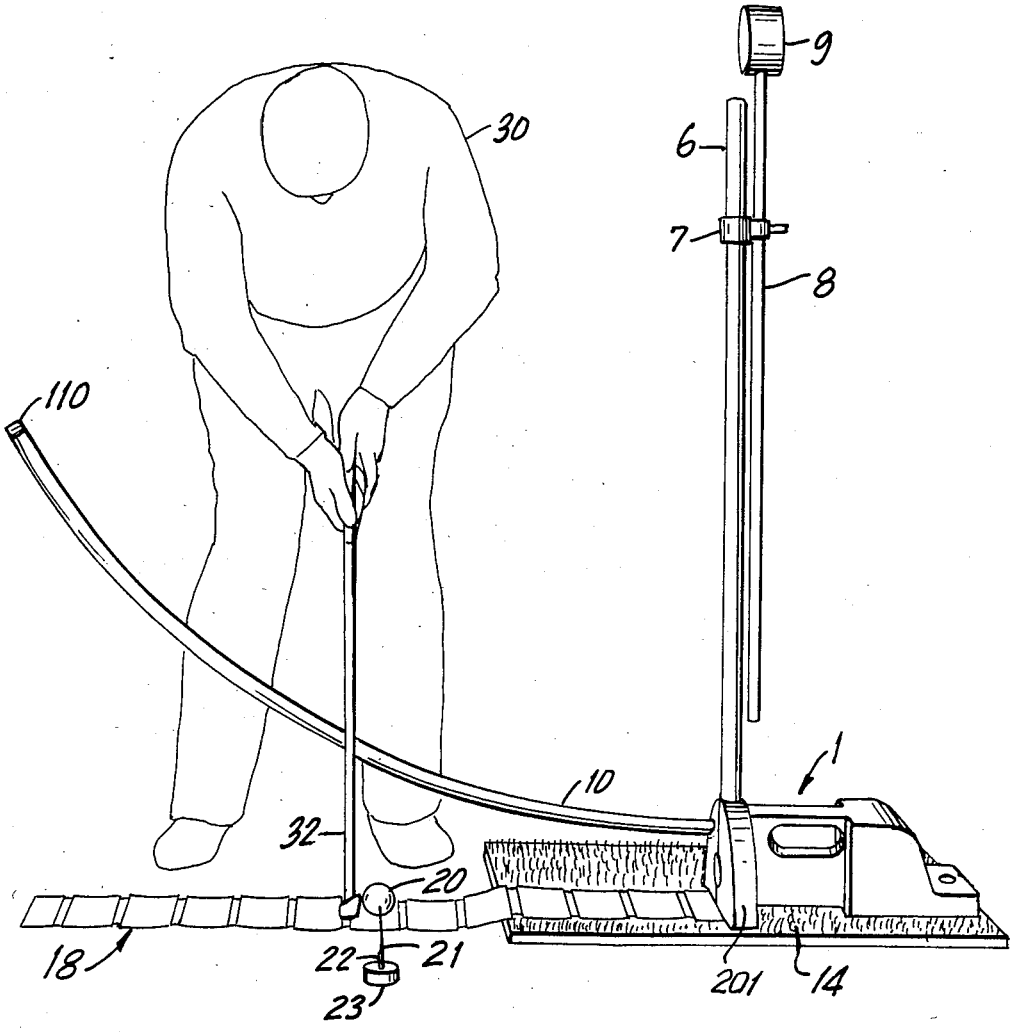
FIGS. 7 and 8 are lateral views of another embodiment of the apparatus of FIGS. 5 and 6 showing exemplary training means for putting.
Figure 8:
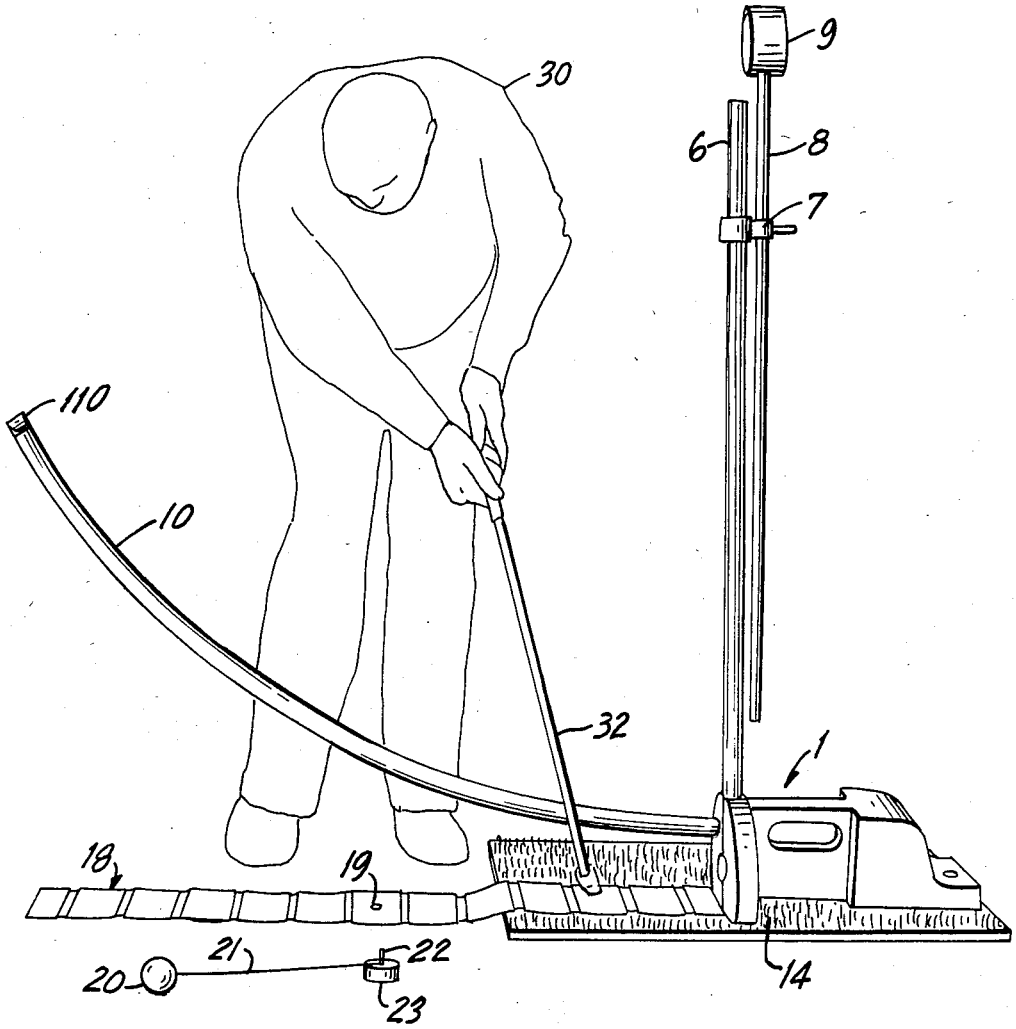

Accordingly, as best shown in FIGS. 7 and 8, the apparatus of the instant invention may advantageously include a putting strip 18 which extends outwardly from the planar surface of anvil 201. Putting strip 18 bears a readily visible mark, such as a perforation or colored dot 19, which is used to position a golf ball 20. As here embodied, golf ball 20 is mounted on support member 21 which, in turn, is pivotally attached to baseplate 23. Baseplate 23 is preferably positioned laterally of putting strip 18. It should be understood that guide rail 10 may also be used with putting strip 18 as an aid to the golfer in perfecting his putting stroke.

In operation of the apparatus illustrated in FIG. 8, golfer 30 may optionally use guide rail 10 to define the path of movement for putter 32. Golfer 30 will hold his head steady so as to see mark 19 appear on putting strip 18 as he strikes ball 20 with his putter 32. By performing this exercise, golfer 30 is taught not to move his head during putting strokes and will learn how to properly direct his putting stroke when addressing ball 20.

In the operation of the apparatus of the instant invention and the practice of the method thereof, a golfer who intends to practice his golf swing will preferably listen to rhythmical tones which have been produced by translation of photographic frames of the swing of a pro player when effecting a significant shot such as a driving shot. The series of photographic frames correspond to the timing of correct swing movements, i.e., the phases of the backswing and downswing of a golf club. From such photographic frames, the present applicant has produced rhythmical tones which are repeated at predetermined time intervals to correspond to the timing of correct swing movements. Advantageously, a golfer will acquire a correct swing form by performing swing training simultaneously with listening to the rhythmical tones. Through repeated practice, a golfer will eventually be able to swing his club in attunement with the rhythmical tones in the same way as a dancer is compelled to effect certain movements when listening to a dance theme.

Figure 11:
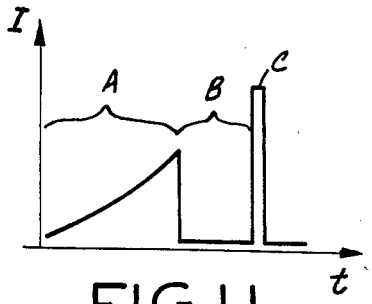
FIGS. 11 and 12 are graphical illustrations of exemplary time-amplitude plots of the rhythmical tones associated with the operation of the apparatus and method of the instant invention.
Figure 12:
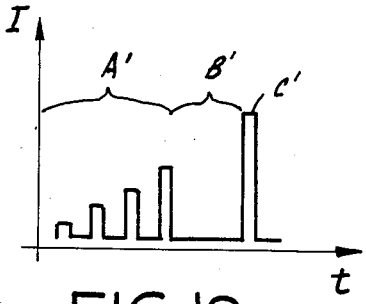

As is apparent from FIGS. 11 and 12, the rhythmical tones emitted during the backswing and downswing time comprise either a sound A (FIG. 11), or a group of sounds A' (FIG. 12) having any desired trend. As preferably embodied, the rhythmical tones are incorporated on a sound track which initially gives the impression of a crescendo so as to induce the golfer to raise the golf club. It should be understood that numerous means may be employed in obtaining this result, such as by adopting sounds of an increasing volume or by using sounds of different pitches or repeating a sound with a constant acceleration, or, as an alternative, by acting upon any other intrinsic property of the sounds concerned.

The performance of a backswing in the instant application is carried out as noted above by first raising the golf club a certain distance in attunement with the crescendo emitted by the timing means. The initial crescendo is preferably followed by a pause time, B, or by any other sound or group of sounds, which have the same duration as that of the downswing phase. For example, if a sound or a group of sounds is adopted instead of a pause, such sounds should preferably give the impression of a decrescendo so that the golfer is urged to move the golf club downwards in an accelerated manner.

This pause or second group of sounds is followed by a sound, C, preferably of a marked time, which acoustically simulates the impact of a golf club onto a golf ball. This sound is clearly distinguishable over the previous tones emitted because it is of a greater amplitude, or of a different pitch.

The completed series of rhythmical tones is repeated at predetermined time intervals to create a musical rhythm. It should be understood that the time intervals and the rate of repetition thereof can be varied in accordance with the golfer's requirements or capabilities.

There are numerous recording devices, such as magnetic cassettes, magnetic tapes or discs and the like which might be employed in the instant invention to record the musical rhythm played during golf swing training. It should also be understood that numerous electronic recording and playing devices might be employed in recording the musical theme onto a magnetic cassette and subsequent playback thereof.

Figure 13:
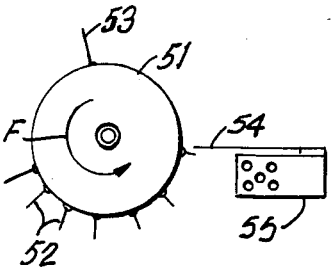
FIG. 13 is a sectional view of an exemplary device which produces the rhythmical tones associated with the method of the instant invention.

As shown in FIG. 13, there is preferably provided a device for producing the rhythmical tones associated with golf swing training. Disc 51, FIG. 13, is mounted on a rotatable shaft (not shown) and means including a motor and driving devices which are not shown are provided to rotate the shaft. Disc 51 includes a plurality of finger-like projections 52 which are secured to its outer periphery. The number of projections secured to disc 51 depends on the swing timing which the golfer is attempting to simulate. A predetermined number of projections 52 are secured to disc 51 and are spaced apart from one another in accordance with the golfer's timing requirements. Disc 51 also includes peg 53 which extends outwardly from the periphery of disc 51 and is angularly spaced apart from projections 52 on the periphery of disc 51. As preferably embodied, peg 53 is greater in length than projections 52.

In operation, disc 51 is rotated at a constant rotation speed in a counterclockwise direction as indicated by arrow F. As disc 51 is rotated, both projections 52 and peg 53 sequentially strike the distal end of reed 54 which is secured at its proximal end to resonance box 55. Resonant tones are produced by box 55 as a result of projections 52 and peg 53 striking reed 54.

As previously mentioned, projections 52 are mounted on the periphery of disc 51 in accordance with the timing requirements of the golfer. For example, the spacing between and length of each projection 52 may be varied such that projections 52 are of the same length and evenly spaced apart from each other or of increasing lengths and differentially spaced apart from each other. The spacing and length of each projection 52 will depend on the particular requirements of the golfer.

The production of rhythmical tones to be used during golf swing training is accomplished by having projections 52 strike reed 54. By striking reed 54, projections 52 generate a sequence of rhythmical tones A, the duration of which corresponds to the backswing or charge phase of the golf club. Tones A are preferably followed by pause time B which corresponds to the downswing phase of the golf club. The musical rhythm is completed when a sharp marked sound C is generated as peg 53 strikes reed 54. This marked sound C responds to the impact of a golf club against a golf ball. It should be noted that the distance separating the last of the projections 52 from peg 53 corresponds to the pause time B between the initial sound sequence A and the final marked sound C and is one factor which determines the tempo of the musical rhythm.

As previously mentioned, the positioning of projections 52 on disc 51 will determine the sequence of initial sounds A. For example, the sequence of initial sounds A may be composed of sounds of the same amplitude which follow each other at regular or decreasing intervals or it may be composed of sounds of increasing amplitude which follow each other at regular, increasing or decreasing time intervals.

It should also be understood that various combinations of projections may be provided on disc 51. The projection combination and resulting musical rhythm are determined by the individual requirements of the golfer. For example, a plurality of sets of projections 52 and pegs 53 may be placed side-by-side on disc 51, so that, by axially shifting disc 51, or by adjusting the position of resonance box 55, the rhythmical tones produced can be changed. Alternatively, disc 51 may be made to be interchangeable with other discs so that resonance box 55 can produce different musical rhythms.

In a slightly modified version (not shown), disc 51 is provided with a plurality of resonance boxes 55 to generate varying musical rhythms. In one mode, one resonance box 55 cooperates with projections 52 while another resonance box 55 co-acts with peg 53. In this situation peg 53 would be staggered relative to projections 52 so as to insure proper separation and define a clear path of movement.

The tempo of the rhythmical tones is also defined by the rotational speed of disc 51 which can be varied by adjustments to the motor and drive means. For example, a golfer can select a tempo for use during golf swing training by adjusting the rotational speed of disc 51 in accordance with his playing capability and age.

In the practice of the method of the instant invention, golfer 30 will acquire proper swing posture when he succeeds in striking golf ball simulator 20 in attunement with the marked sound C which is cyclically repeated in the rhythmical tones emitted from resonance box 55. Advantageously, a golfer will memorize proper swing posture and form and will be able to repeat it on the golf green by practicing the method of the instant invention for a few minutes a day.

The apparatus of the instant invention might also be modified by utilizing a small band conveyor or drum in place of disc 51.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed:

1. A method for teaching a golfer to swing a golf club in a predetermined swing plane having a swing guide means and provided with an anvil having a vertically oriented planar surface against which the striking face of a golf club head will impact, the steps comprising positioning said swing guide means in a predetermined swing plane, positioning a golfer laterally of said swing guide means, placing said golf club on said guide means, guiding a backswing and a downswing of said golf club by moving said golf club on said swing guide means to cause impact of said striking face with said planar surface, and timing said backswing and downswing of said golf club by moving said club in attunement with rhythmical tones corresponding to a predefined swing tempo.

2. A method, as recited in claim 1, in which said guide means is positioned to form either a convex or concave swing path.

3. A method, as recited in claim 1, in which said golf club includes a flexible rod and a flat head piece.

4. A method, as recited in claim 3, in which said golf club head is moved downwardly on said swing guide means to strike said anvil.

5. A method, as recited in claim 1, in which said rhythmical tones are repeated at predetermined time intervals to control the movements of said golf club during said backswing and said downswing.

6. A method, as recited in claim 5, in which said rhythmical tones include a crescendo and a decrescendo, said crescendo inducing said golfer to raise said golf club on said swing guide means after which said golfer is induced by said decrescendo to move said golf club downwards.

7. An apparatus for golf swing training comprising:

(i) a base including an anvil having a vertically oriented planar surface for contact with a golf club head during golf swing play and a plurality of mounting means located thereon, said planar surface of said anvil causing a golfer's wrists to straighten upon said contact between said planar surface and said golf club head;

(ii) means for guiding a golf club in at least one of a plurality of predetermined swing paths, said paths including one leading to said planar surface, said guiding means being connected to a first of said plurality of mounting means; and (iii) positioning means pivotably attached to a support member mounted in a second of said plurality of mounting means, said positioning means being adjustable along said support member for positioning a golfer with respect to said at least one swing path defined by said guiding means.

8. An apparatus, as recited in claim 7, in which said base includes a handle for transporting said apparatus and constraining means to secure said base to the ground.

9. An apparatus, as recited in claim 7, in which said base includes a lateral fastening means for adjustably securing a flexible member to one side of said base, and a flexible member secured to said fastening means including a boss on its distal end for contact with said golf club head during a golf club swing.

10. An apparatus, as recited in claim 9, in which said base includes rebounding means for returning said flexible member to its resting position relative to said base after said flexible member has been struck by said golf club head.

11. An apparatus, as recited in claim 9, in which said flexible member includes a reinforcement rib secured to said fastening means and extending outwardly from the proximal end of said flexible member, said rib providing resistance against the striking force of said golf club head during contact with said flexible member.

12. An apparatus, as recited in claim 7, in which said support member is a vertical rod mounted on said anvil.

13. An apparatus, as recited in claim 7, in which said positioning means includes a pad-like member on its distal end which provides a surface against which a golfer can position his head.

14. An apparatus, as recited in claim 7, in which said guiding means is a tube-like rail extending outwardly from said anvil during a golf swing training, said guiding means having a predetermined contour defining a swing path.

15. An apparatus, as recited in claim 13, in which said guiding means is tapered at its distal end thereby preventing a golfer from striking said distal end of said guiding means during golf swing training.

16. An apparatus, as recited in claim 13, in which said guiding means is positioned to form either a convex or concave swing path.

17. An apparatus, as recited in claim 7, in which said base includes a socket for holding said guiding means to reduce space requirements when said apparatus is not in use.

18. An apparatus, as recited in claim 7, which further includes a putting strip which extends outwardly from the planar surface of said anvil.

19. An apparatus, as recited in claim 18, in which said putting strip includes a reference mark on which to position a golf ball.

20. An apparatus, as recited in claim 18, in which said putting strip is positioned under said guiding means, said guiding means defining a path of movement along which a golfer may swing a putter.

21. An apparatus, as recited in claim 7, which further includes a swing timing means, said timing means emitting rhythmical tones corresponding to various phases of a golf club swing.

22. An apparatus, as recited in claim 21, in which said timing means repeatedly emits said rhythmical tones at designated time intervals.

23. An apparatus, as recited in claim 21, in which said timing means is a disc mounted on a rotatable shaft, said timing means including drive means for rotating said shaft at a predetermined speed.

24. An apparatus, as recited in claim 23, in which said disc includes a plurality of finger-like projections, said projections being mounted and spaced apart from each other on the outer periphery of said disc to produce said rhythmical tones.

25. An apparatus, as recited in claim 24, in which said disc further includes a peg extending outwardly from the periphery of said disc a distance greater than said projections.

26. An apparatus, as recited in claim 25, in which said timing means includes at least one resonance box, said resonance box having secured to it one or more reeds for producing rhythmical tones.

27. An apparatus, as recited in claim 26, in which said reeds are caused to vibrate and produce said rhythmical tones upon contact with said projections as said disc is rotated.

28. An apparatus, as recited in claim 27, which includes means for modifying the position of said reeds relative to said projections.

* * * * *